US005325113A

United States Patent [19]

Takeda

[11] Patent Number: 5,325,113

[45] Date of Patent: Jun. 28, 1994

[54] RESISTIVE SHEET THERMAL TRANSFER PRINTER

[75] Inventor: Yusuke Takeda, Yokohama, Japan

[73] Assignee: Ricoh Company, Ltd., Tokyo, Japan

[21] Appl. No.: 838,541

[22] Filed: Feb. 19, 1992

[30] Foreign Application Priority Data

Feb. 21, 1990 [JP] Japan ..... 3-048890

[51] Int. Cl.[5] ..... B41J 2/37

[52] U.S. Cl. ..... 346/76 PH; 400/120

[58] Field of Search ..... 346/76 PH; 400/120

[56] References Cited

U.S. PATENT DOCUMENTS

| | | | |
|---|---|---|---|
| 4,639,741 | 1/1987 | Inoue | 346/76 PH |
| 4,970,530 | 11/1990 | Takeda | 346/76 PH |
| 5,079,566 | 1/1992 | Mori | 346/76 PH |
| 5,089,831 | 2/1992 | Ito et al. | 346/76 PH |
| 5,107,277 | 4/1992 | Mori | 346/76 PH |

FOREIGN PATENT DOCUMENTS

| | | | |
|---|---|---|---|
| 0154372 | 6/1988 | Japan | 346/76 PH |
| 0197667 | 8/1988 | Japan | 346/76 PH |

OTHER PUBLICATIONS

"Electric Ink Transfer Recording Method Using Multi-Stylus" (Journal of the Institute of Image Electronics Engineers of Japan 16, 1 (1987) )*.

*Primary Examiner*—Benjamin R. Fuller
*Assistant Examiner*—Huan Tran
*Attorney, Agent, or Firm*—Cooper & Dunham

[57] ABSTRACT

A resistive sheet thermal transfer printer includes a printing head having m (m is an integer) recording electrodes and a common electrode both-in contact with a resistance layer of an ink sheet, the m recording electrodes being arranged in a line, and being separated from the common electrode by a predetermined distance, where m is an integer, a driving circuit for applying a driving voltage across the common electrode and one or plurality of recording electrodes selected from the m recording electrodes in accordance with printing data supplied from an external unit, a controller for controlling the driving circuit, when the driving voltage is simultaneously applied across the common electrode and selected successively arranged recording electrodes, so that an amount of driving voltage applied across the common electrode and an end recording electrode positioned at an end of the selected successively arranged recording electrodes is less than an amount of driving voltage applied across the common electrode and each of the selected successively arranged recording electrodes other than the end recording electrode.

6 Claims, 4 Drawing Sheets

RESISTIVE SHEET THERMAL TRANSFER PRINTER

BACKGROUND OF THE INVENTION

Field of the invention

The present invention generally relates to a resistive sheet thermal transfer printer, and more particularly to a resistive sheet thermal transfer printer in which unevenness of the density of a line image formed of a plurality of dots can be prevented. The unevenness of the density of the line image is referred to as a multi-dot density unevenness.

A description will now be given of a conventional resistive sheet thermal transfer printer with reference to FIGS.1 and 2.

Referring to FIG.1, an ink sheet 501 is put upon a recording sheet 502. The ink sheet 501 has a resistance layer 501*a*, a conductive layer 501*b* and an ink dyes layer 501*c*. The conductive layer 501*b* is sandwiched between the resistance layer 501*a* and the ink dyes layer 501*c*, and the ink dyes layer 501*c* is in contact with the recording sheet 502. The resistance layer 501*a* is made, for example, of an Aramid film including carbon grains. The conductive layer 501*b* is made, for example, of aluminum. A common electrode 503 and a plurality of recording electrodes 504 arranged in a line are arranged at predetermined interval on the resistance layer 501*a* of the ink sheet 501. The common electrode 503 and the recording electrodes 504 are pressed against the resistance layer 501*a*.

When a voltage is applied across the common electrode 503 and each of the recording electrodes 504, an electric current flows through a first part of the resistance layer 501*a* corresponding to the common electrode 503, the conductive layer 501*b* between the common electrode 503 and each of the recording electrodes 504, and a second part of the resistance layer 501*a* corresponding to each of the recording electrodes 504, as shown by arrows in FIG.1. In this case, when the electric current flows through the first and second part of the resistance layer 501*a*, Joule heat is generated from each of the first and second parts of the resistance layer 501*a*. An amount of Joule heat generated in the resistance layer 501*a* is proportional to the square of electric current density therein. Thus, as the end surface of each of the recording electrodes 504 is smaller than that of the common electrode 503, the generation of Joule heat is concentrated in the second part of the resistance layer 501*a* corresponding to each of the recording electrodes 504 (an area shown by a slanted lines in FIG.1). The ink in the ink dyes layer 501*c*, positioned under each of the recording electrodes 504, is fused and sublimated due to the Joule heat in the second part of the resistance layer 501*a*, so that ink corresponding to each of the recording electrodes is transferred to the recording sheet 502.

In the above conventional resistive sheet thermal transfer printer, when the voltage is simultaneously supplied to successive some of the electrodes 504, the following problem occurs.

For example, when the voltage is simultaneously supplied to three of m recording electrodes 504, second (2), third (3) and fourth (4) recording electrodes 504, as shown in FIG.2, an additional current flows into end positioned recording electrodes, such as the second and fourth recording electrodes (2) and (4), from a periphery thereof. Thus, in this case, the amount of current flowing into the third recording electrode (3) between the second and fourth electrodes (2) and (4) is less than the amount of current flowing into the end positioned recording electrodes, the second and fourth recording electrodes (2) and (4) in this case. That is, the amount of heat generated in the resistance layer corresponding to the third recording electrode (3) is less than the amount of heat generated therein corresponding to the end positioned recording electrode. As a result, unevenness of the density occurs in the image formed on the recording sheet 502.

To eliminate the above problem, conventionally, "ELECTRIC INK TRANSFER RECORDING METHOD USING MULTI-STYLUS" has been proposed in THE JOURNAL OF THE INSTITUTE OF IMAGE ELECTRONICS ENGINEERS OF JAPAN 16, 1, (1987). In this method, one line is divided into a plurality of blocks, and the voltage is not simultaneously supplied to adjacent recording electrodes.

However, in the above method, as one line image is printed through printing a divided plurality of blocks, the time required for printing one line increases. Thus, the printing speed is decreased.

SUMMARY OF THE INVENTION

Accordingly, a general object of the present invention is to provide a novel and useful resistive sheet thermal transfer printer in which the disadvantages of the aforementioned prior art are eliminated.

A more specific object of the present invention is to provide a resistive sheet thermal transfer printer in which the degree of unevenness of the density in one line image can be decreased without decreasing the printing speed.

The above object of the present invention are achieved by a resistive sheet thermal transfer printer for printing a dot image by using a current sensitized ink sheet having a resistance layer, a conductive layer and an ink layer, said printer comprising: a printing head having m (m is an integer) recording electrodes and a common electrode both in contact with the resistance layer of said ink sheet, said m recording electrodes being arranged in a line and separated from said common electrode at a predetermined distance; energy supplying means for applying an electric energy across said common electrode and one or plurality of recording electrodes selected from said m recording electrodes in accordance with printing data supplied from an external unit; and control means for controlling said energy supplying means, when the electric energy is simultaneously applied across said common electrode and selected successively arranged recording electrodes, so that an amount of electric energy applied across said common electrode and an end recording electrode positioned at an end of said selected successively arranged recording electrodes is less than an amount of electric energy applied across said common electrode and each of said selected successively arranged recording electrodes other than said end recording electrode, wherein ink in the ink layer is transferred, by heat generated from the resistance layer based on the electric energy supplied to said printing head, to a recording medium in contact with the ink layer of said ink sheet.

According to the present invention, the amount of electric energy applied across the common electrode and the end recording electrode positioned at an end of a plurality of selected successively arranged recording electrodes is decreased. Thus, even if there is an additional current flowing into the end recording electrode, a total amount of energy supplied to each of selected recording electrode is almost the same. As a result, a degree of unevenness of the density in one line image can be decreased. In addition, the printing speed is not decreased.

Additional objects, features and advantages of the present invention will become apparent from the following detailed description when read in conjunction with the accompanying drawings.

DESCRIPTION OF PREFERRED EMBODIMENTS

A description will now be given on an embodiment of the present invention.

Figure 3:
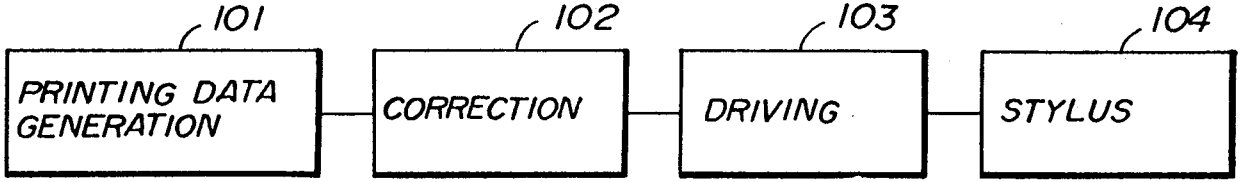
FIG.3 is a block diagram illustrating functions of the resistive sheet thermal transfer printer according to the embodiment of the present invention.

A resistive sheet thermal transfer printer of this embodiment has functions shown in FIG.3.

Referring to FIG.3, a printing data generation block 101 generates printing data line by line each line including m dots. Each of m dots in the printing data corresponds to one of the recording electrodes 504 and is either a printing dot or a non-printing dot. A driving voltage is supplied to each recording electrode corresponding to a printing dot, and is not supplied to each recording electrode corresponding to the non-printing dot. A correction block 102 corrects the driving voltage corresponding to each printing dot placed between other printing dots. A driving block 103 drives each stylus (corresponding to each recording electrode) in a stylus block 104 based on the driving voltage supplied from the correction block 102.

Figure 4:
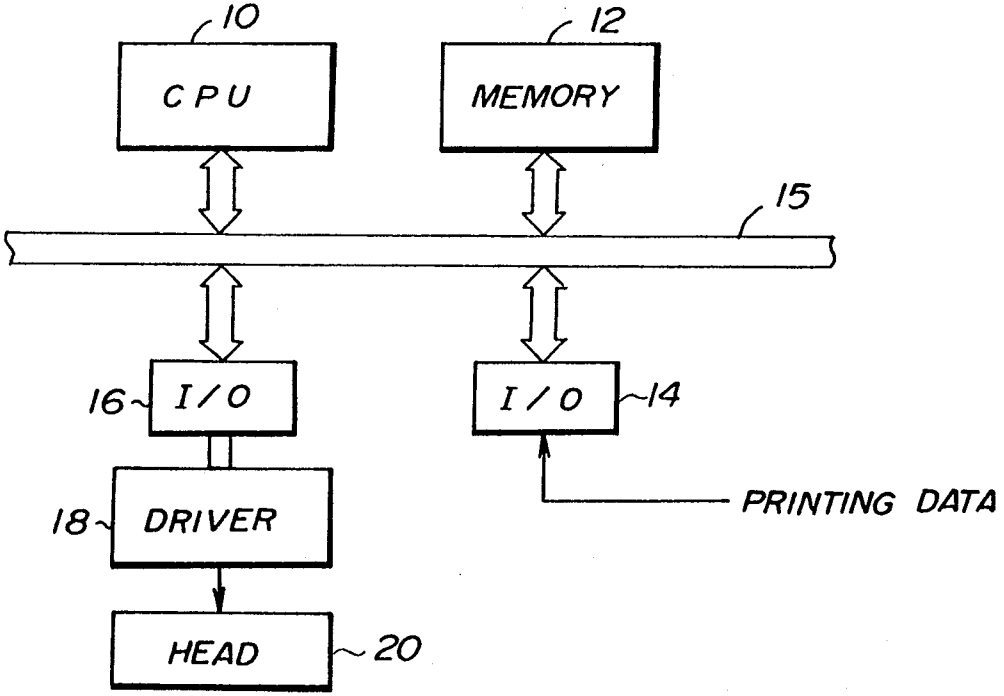
FIG.4 is a block diagram illustrating control system in a resistive sheet thermal transfer printer according to an embodiment of the present invention.

The above functions are performed, for example, in a control system shown in FIG.4.

Referring to FIG.4, this control system has a CPU 10 (a Central Processing Unit), a memory 12, an input interface circuit 14 coupled to an external device (e.g. a host computer or a scanner), and an output interface circuit 16, which are connected by a system bus 15 to each other. The output interface circuit 16 is connected to a driver circuit 18 for driving a printing head 20 including the common electrode 503 and the recording electrodes 504 shown in FIGS.1 and 2. The CPU 10 controls each part of this system in accordance with predetermined programs. The memory 12 stores printing data for one page and other such data. The driver circuit 18 drives the printing head 20 in accordance with instructions supplied from the CPU 10 via the system bus 15 and the output interface circuit 16.

Figure 1:
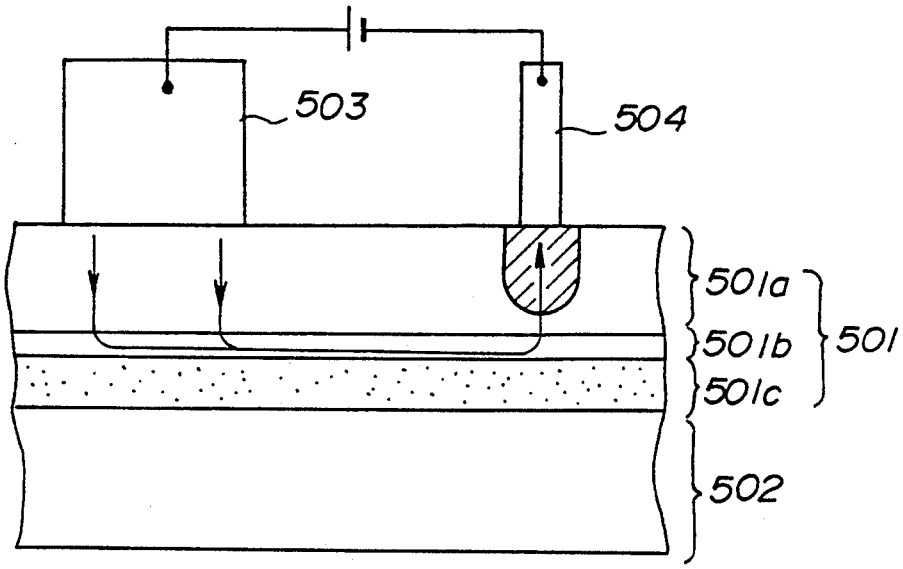
FIG. 1 (PRIOR ART)
FIG.1 is a diagram illustrating a structure of a head of a conventional resistive sheet thermal transfer printer.
Figure 2:
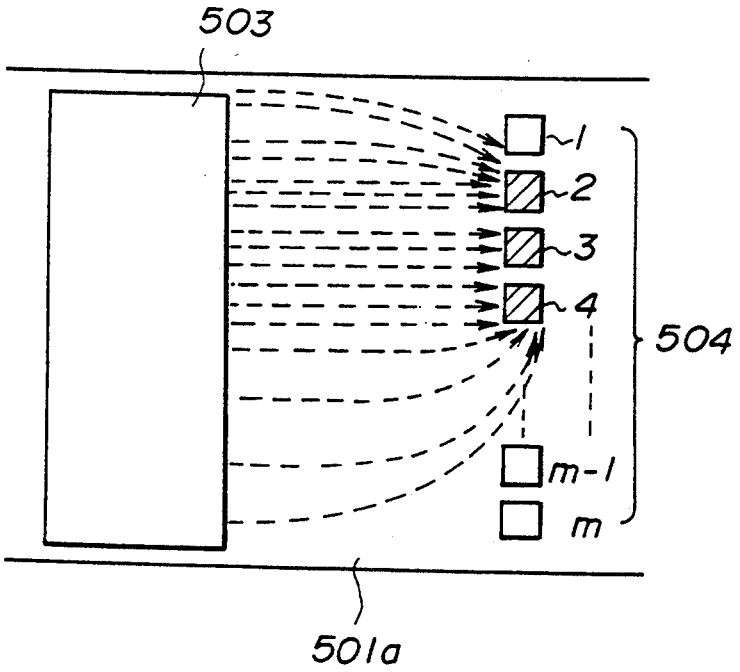
FIG. 2 (PRIOR ART)
FIG.2 is a diagram illustrating electric currents flowing into recording electrodes.

The printing head 20 has the same structure as the conventional one shown in FIGS.1 and 2. That is, the printing head 20 has the common electrode 503 and m recording electrodes 504. The driver circuit 18 selects the recording electrodes to be driven, in accordance with the printing data, and supplies a driving voltage to the selected recording electrodes.

Figure 5:
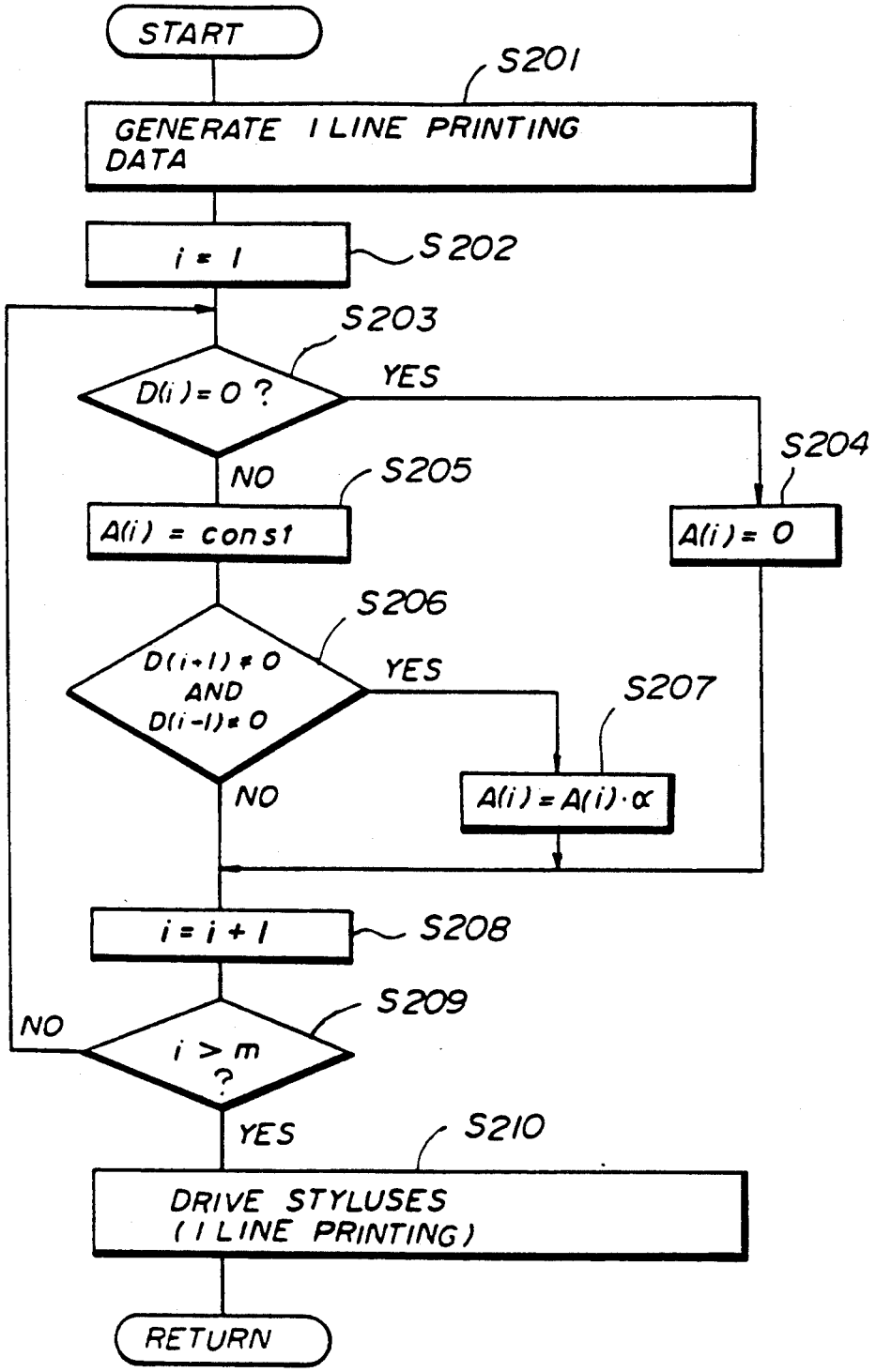
FIG.5 is a flow chart illustrating a first example of a process carried out in the control system shown in FIG.4.

The above control system carries out a process in accordance with a flow chart shown in FIG.5. This process is carried out by the CPU 10.

The printing data of one page supplied from an external unit, such as a host computer or an image scanner, is taken into the memory 12 via the input interface circuit 14 and the system bus 15, and stored therein. In this state, step S201 reads out the printing data for one line of the image from the memory 12 and stores it in a buffer in the CPU 10. Step S202 initializes a counter i at "1" ($i=1$). Then, step S203 determines whether or not an i-th dot (D(i)) in the printing data for one line is a non-printing dot ($D(i)=0$) with reference to the printing data in the buffer. When step S203 determines that the i-th dot D(i) is the non-printing dot, step S204 sets an i-th driving voltage A(i), which should be applied across an i-th recording electrode (i-th stylus) and the common electrode, to 0 volts ($A(i)=0$). Contrastingly, when step S203 determines that the i-th dot is a printing dot ($D(i)\neq 0$), step S204 sets an i-th driving voltage A(i) at a constant value Vo. Then step S206 determines whether or not both dots $D(i+1)$ and $D(1-1)$ adjacent to the i-th dot D(i) are the printing dots ($D(i+1)\neq 0$ and $D(i-1)\neq 0$). When step S206 determines that both the adjacent dots $D(i+1)$ and $D(i-1)$ are the printing dots, step S207 corrects the i-th driving voltage A(i) in accordance with $A(i)=A(i).\alpha$, where $\alpha$ is a coefficient greater than 1 ($\alpha>1$). That is, the i-th driving voltage A(i) is set to $Vo.\alpha$ greater than the normal driving voltage Vo.

When the result obtained in step S206 is No, or after step S207, the counter i is incremented by 1 ($i=i+1$). Then step S209 determines whether or not a count value in the counter is greater than m which is the number of dots included in the line of to be printed data. The above process (including steps S203, S204, S205, S206, S207, S208 and S209) is repeatedly carried out until the count value in the counter has become greater than m. Then when step S209 determines that the count value becomes greater than m, step S210 drives the styluses (104) so that the driving voltage A(i) set as described above is supplied to corresponding recording electrodes. That is, no voltage (0 volt) is supplied to each recording electrode corresponding to a non-printing dot, and a constant voltage Vo is supplied to each recording electrode corresponding to printing dots which have at least one adjacent dot that is a non-printing dot. The corrected voltage $Vo.\alpha$ is supplied to each recording electrode corresponding to printing dots positioned between printing dots.

The flow chart shown in FIG.5 is a process for forming one line of image. Thus, to form an image for one page including n line images, the above process is repeated n times.

The coefficient $\alpha$ used for correcting the driving voltage A(i) is determined based on an electrical characteristic of the ink sheet 502, a distance between the common electrode 503 and each of the recording electrodes 504, an area of each of the recording electrodes 504, and other such factors. The coefficient $\alpha$ is set, for example, to 1.5 in a case where each of the recording electrodes 504 has an area of 100 $\mu m \times 100$ $\mu m$, the distance between the common electrode 503 and each of the recording electrodes 504 is about 1 mm, and the resistance layer 501*b* of the ink sheet has a thickness of 10 um and a resistance of a few kilo-ohms per $cm^2$.

According to the above embodiment, when successive recording electrodes corresponding to the printing dots are simultaneously driven, the corrected voltage Vo-$\alpha$ greater than the normal voltage Vo, supplied to the end positioned recording electrodes, is the same for each of the recording electrodes between both the end positioned recording electrodes. Thus, even if an additional electric current flows into only each of the end positioned recording electrodes, the total amount of electrical current flowing into each of the successive recording electrodes corresponding to the printing dots is almost the same. As a result, a degree of unevenness of the density in one line of image can be decreased. In this case, as m dots are simultaneously printed in one line, the printing speed is not decreased.

Figure 6:
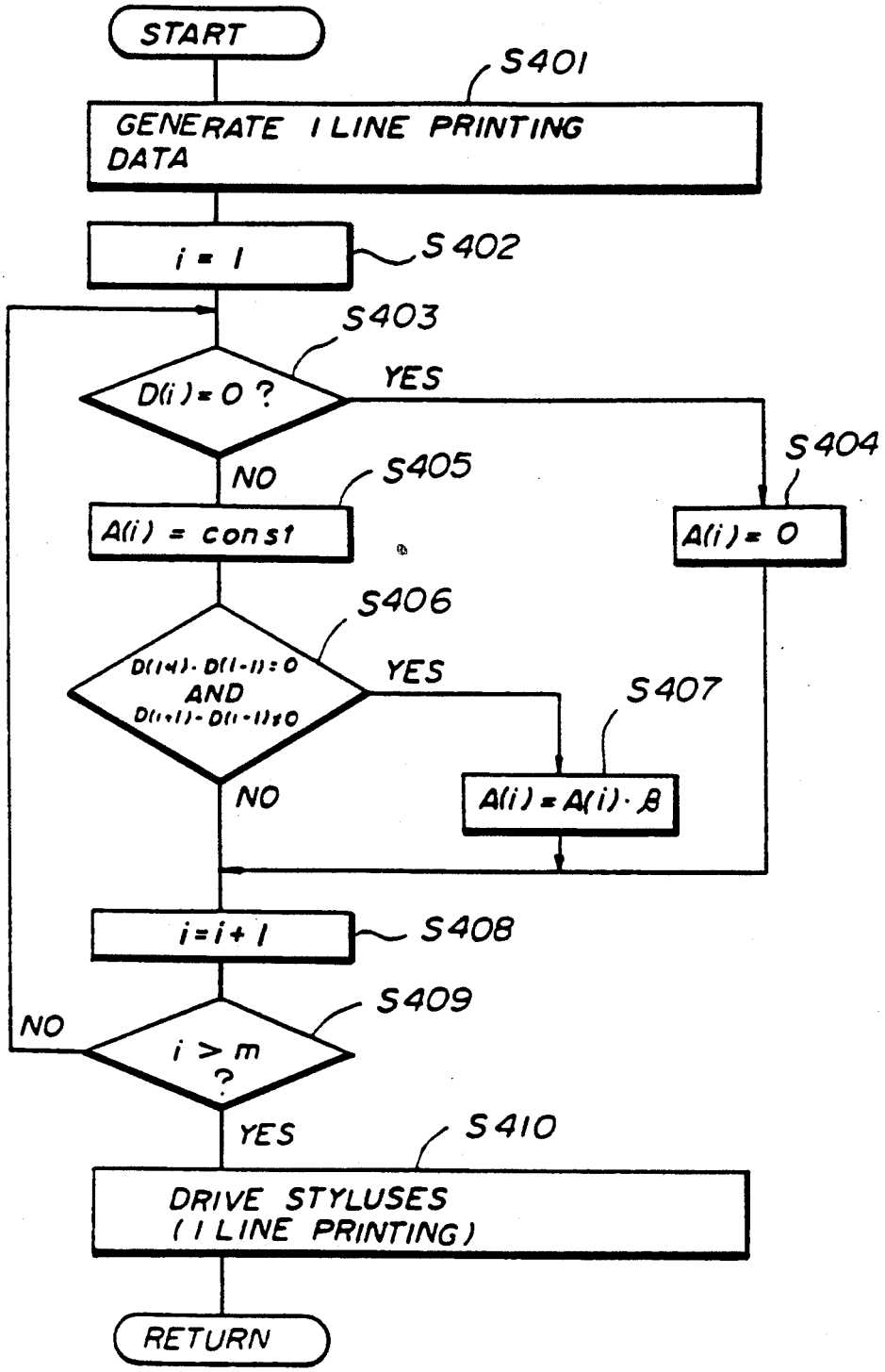
FIG.6 is a flow chart illustrating a second example of the process carried out in the control system shown in FIG.4.

A description will now be given of a second example of a process carried out in the control system with reference to FIG.6. In FIG.6, step S401 for generating printing data for one line, step S402 for initializing a counter at "1", step S403 for determining whether or not an i-th dot D(i) is a non-printing dot, step S404 for setting an i-th driving voltage A(i) at "0" (A(i)=0), step S405 for setting an i-th driving voltage A(i) at the constant value Vo, step S408 for incrementing the count value in the counter by one, step 409 for determining whether or not the count value is greater than m, and step S410 for driving styluses for printing of one line are carried out in the same manner as steps S201, S202, S203, S204, S205, S208, S209, and S210 shown in FIG.5.

In the process shown in FIG.6, step S406 determines whether or not one of both dots D(i+1) and D(i-1) of the i-th dot D(i) is a non-printing dot. In a case where the printing dot corresponds to "1" and the non-printing dot corresponds to "0", if $D(i+1)\cdot D(i-1)$ equals 0 and $D(i+1)+D(i-1)$ is not equal to 0, step S406 determines that one of the adjacent dots D(i+1) and D(i−1) of the i-th dot (D(i) is a non-printing dot. When the result in step 406 is Yes, step S407 corrects the driving voltage A(i) in accordance with $A(i)=A(i)\cdot\beta$, where $\beta$ is a coefficient less than 1 ($0<\beta<1$). That is, the i-th driving voltage is set to Vo·$\beta$ which is less than the normal driving voltage Vo.

According to the above embodiment, when successive recording electrodes corresponding to the printing dots are simultaneously driven, the corrected voltage Vo·$\beta$ which is less than the normal voltage Vo, supplied to each of the recording electrodes between the end positioned recording electrodes, is supplied to each of the two end positioned recording electrodes. Thus, even if an additional electric current flows into only each of the end positioned recording electrodes, the total amount of electrical current flowing into each of the successive recording electrodes corresponding to printing dots is almost the same. As a result, a degree of unevenness of the density in one line image can be decreased. In this case, as m dots in one line are simultaneously printed, the printing speed is not decreased.

The above coefficient $\beta$ is also determined based on an electrical characteristic of the ink sheet 502, a distance between the common electrode 503 and each of the recording electrodes 504, an area of each of the recording electrodes 504 and other such characteristics. The coefficient $\beta$ is set, for example, at about 1/1.5 (=0.67).

The above control system controls the driving voltage supplied to each of the recording electrodes. Furthermore, the control system may control an energy supplied to each of the recording electrodes, such as a pulse width of the driving voltage.

The present invention is not limited to the aforementioned embodiments, and variations and modifications may be made without departing from the scope of the claimed invention.

What is claimed is:

1. A resistive sheet thermal transfer printer for printing a dot image by using a current sensitized ink sheet having a resistance layer, a conductive layer and an ink layer wherein ink in the ink layer is transferred, by heat generated from the resistance layer, to a recording medium in contact with the ink layer of said ink sheet, said printer comprising:

a printing head having a plurality of recording electrodes and a common electrode both in contact with the resistance layer of said ink sheet, said plurality of recording electrodes being arranged in a line, and being separated from said common electrode by a predetermined distance;

energy supplying means for applying electric energy across said common electrode and selected ones of said plurality of recording electrodes selected in accordance with printing data supplied from an external unit; and control means for controlling said energy supplying means, so that when electric energy is simultaneously applied across said common electrode and selected successively arranged recording electrodes, an amount of electric energy applied across said common electrode and an end recording electrode positioned at an end of said selected successively arranged recording electrodes is less than an amount of electric energy applied across said common electrode and each of said selected successively arranged recording electrodes other than said end recording electrode.

2. A printer as claimed in claim 1, wherein said energy supplying means applies a predetermined amount of electric energy across said common electrode and said selected ones of said plurality of recording electrodes, and wherein said control means has first correction means for correcting the amount of electric energy applied across said common electrode and each of said selected successively arranged recording electrodes other than said end recording electrode so that the amount of electric energy is increased.

3. A printer as claimed in claim 2, wherein said first correction means has determining means for determining whether or not recording electrodes adjacent to a selected one of said plurality of recording electrodes are selected for printing, and increasing means for increasing the amount of electric energy applied across said common electrode and the selected one of said plurality of recording electrodes when said determining means determines that the recording electrodes adjacent to the selected one of said plurality of recording electrodes are selected for printing.

4. A printer as claimed in claim 1, wherein said energy supplying means applies a predetermined amount of electric energy across said common electrode and said selected ones of said plurality of recording electrodes, and wherein said control means has second correction means for correcting the amount of electric energy applied across said common electrode and said end recording electrode so that the amount of electric energy applied is decreased.

5. A printer as claimed in claim 2, wherein said second correction means has determining means for determining whether or not only one of two recording electrodes adjacent to a selected one of said plurality of recording electrodes is selected for printing, and decreasing means for decreasing the amount of electric energy applied across said common electrode and the selected one of said plurality of recording electrodes when said determining means determines that only one of the recording electrodes adjacent to the selected one of said plurality of recording electrodes is selected for printing.

6. A printer as claimed in claim 1, wherein said energy supplying means applies a driving voltage, as the electric energy, across said common electrode and each of said selected ones of said plurality of recording electrodes.

* * * * *